US008813509B2

(12) United States Patent
White et al.

(10) Patent No.: US 8,813,509 B2
(45) Date of Patent: Aug. 26, 2014

(54) ICE MAKING ASSEMBLY WITH OPTIMIZED HARVESTING AND RELATED REFRIGERATION APPLIANCE

(75) Inventors: Lorina June White, Louisville, KY (US); Alan Joseph Mitchell, Louisville, KY (US); Jeffrey Michael Colyer, Louisville, KY (US); Joseph Michael Hauser, Louisville, KY (US)

(73) Assignee: General Electric Company, Schenectady, NY (US)

( * ) Notice: Subject to any disclaimer, the term of this patent is extended or adjusted under 35 U.S.C. 154(b) by 643 days.

(21) Appl. No.: 13/151,551

(22) Filed: Jun. 2, 2011

(65) Prior Publication Data

US 2012/0304676 A1 Dec. 6, 2012

(51) Int. Cl.
*F25C 5/02* (2006.01)
*F25C 5/08* (2006.01)
*F25C 1/04* (2006.01)

(52) U.S. Cl.
CPC ... *F25C 1/04* (2013.01); *F25C 5/08* (2013.01); *F25C 2400/10* (2013.01)
USPC ..... 62/135; 62/233; 62/349

(58) Field of Classification Search
USPC ..... 62/66, 71, 73, 135, 233, 349, 351, 352
See application file for complete search history.

(56) References Cited

U.S. PATENT DOCUMENTS

| | | | | |
|---|---|---|---|---|
| 6,574,974 | B1 | 6/2003 | Herzog et al. | |
| 6,857,279 | B2 | 2/2005 | Kim et al. | |
| 7,032,391 | B2 * | 4/2006 | Tremblay et al. | 62/68 |
| 7,051,541 | B2 | 5/2006 | Chung et al. | |
| 7,080,518 | B2 | 7/2006 | Kim et al. | |
| 7,216,491 | B2 | 5/2007 | Cole et al. | |
| 7,748,231 | B2 | 7/2010 | Chung | |
| 2009/0178420 | A1 | 7/2009 | Amonett et al. | |

* cited by examiner

*Primary Examiner* — Marc Norman
(74) *Attorney, Agent, or Firm* — Sority & Manning, P.A.

(57) ABSTRACT

An ice making assembly for a refrigeration appliance includes an ice maker having a mold body defining a plurality of compartments for forming ice cubes therein, a heating element for heating the ice cubes to create a melted portion to assist in removal of the ice cubes from the compartment, and a harvesting assembly including a plurality of elements attached to a rotatable rod. Each element is movable via rotation of the rod through a respective one of the compartments to remove an ice cube from the compartment. Rotation of the rod stopping for a period of time at a stop position in which a removed ice cube can rest atop the harvesting assembly to refreeze the melted portion. Related refrigeration appliances are also disclosed.

19 Claims, 5 Drawing Sheets

ICE MAKING ASSEMBLY WITH OPTIMIZED HARVESTING AND RELATED REFRIGERATION APPLIANCE

FIELD OF THE INVENTION

The subject matter disclosed herein is related generally to ice-making assemblies having heating elements for ice cube harvesting and related refrigeration appliances.

BACKGROUND OF THE INVENTION

In a refrigeration appliance such as a refrigerator or freezer, several systems have been proposed for cooling of an ice maker within the refrigerator or freezer cabinet. In some systems, the ambient air within a freezer is chilled to a temperature low enough to form the ice. In other systems, known as directly cooled systems, a cooling loop for the ice maker is added to typical the refrigeration loop. The ice maker cooling loop can be routed through the mold body of the ice maker, thereby directly cooling the ice maker to increase the rate at which ice can be formed in the ice maker.

Often, a heating device of some sort is provided to help remove ice cubes from the mold compartments in which they are formed. An electrical strip heater can be used beneath the mold for example to heat the mold generally, thereby slightly melting the ice cubes and allowing them to be removed by arms of a harvester. In some devices, warm refrigerant can also be passed through the ice maker mold when ice cubes are ready for harvest to melt the cubes slightly.

However, applying enough heat to fully melt the surface of an ice cube to allow it to be removed from the mold compartment requires a given amount of energy for the heating. Heating ice cubes causing such melting is in some ways inherently inefficient (energy needed to freeze; then more energy needed to melt). Also, regardless of energy issues, slightly melted ice cubes may refreeze in undesirable ways in the cold environment, for example sticking to the ice maker or ice cube bucket, or to each other in the ice maker or ice cube bucket causing clogs. Accordingly, an alternate system of removing ice cubes from compartments in the ice cube mold, addressing one or more of the above issues or others would be welcome.

BRIEF DESCRIPTION OF THE INVENTION

Aspects and advantages of the invention will be set forth in part in the following description, or may be obvious from the description, or may be learned through practice of the invention.

According to certain aspects of the disclosure, an ice making assembly for a refrigeration appliance includes an ice maker having a mold body defining a plurality of compartments for forming ice cubes therein, a heating element for heating the ice cubes to create a melted portion to assist in removal of the ice cubes from the compartment, and a harvesting assembly including a plurality of elements attached to a rotatable rod. Each element is movable via rotation of the rod through a respective one of the compartments to remove an ice cube from the compartment. Rotation of the rod stopping for a period of time at a stop position in which a removed ice cube can rest atop the harvesting assembly to refreeze the melted portion. Various options and modifications are possible.

According to certain other aspects of the disclosure, a refrigeration appliance includes a refrigerated cabinet, an ice maker within the refrigerated cabinet including a mold body defining a plurality of compartments for forming ice cubes therein, a heating element for heating the ice cubes to create a melted portion to assist in removal of the ice cubes from the compartment, and a harvesting assembly including a plurality of elements attached to a rotatable rod. Each element is movable via rotation of the rod through a respective one of the compartments to remove an ice cube from the compartment. Rotation of the rod stops for a period of time at a stop position in which a removed ice cube can rest atop the harvesting assembly to refreeze the melted portion. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
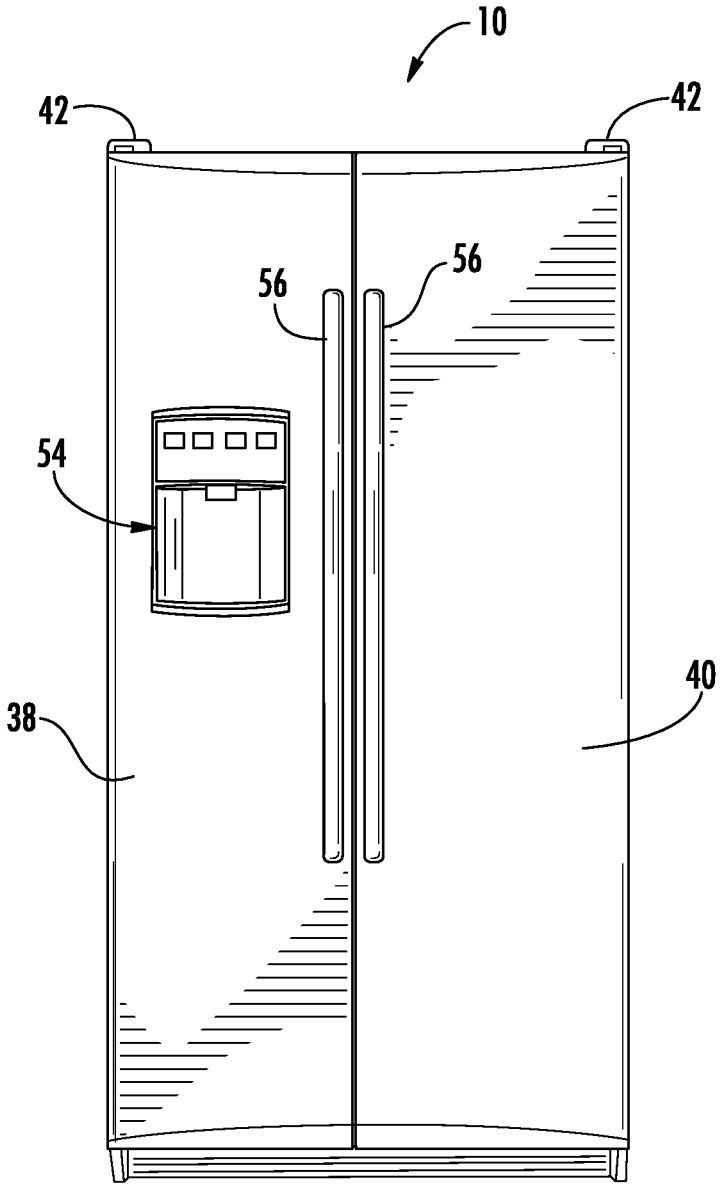
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an exemplary refrigeration appliance 10 depicted as a refrigerator in which ice-making assemblies in accordance with aspects of the present invention may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth.

Figure 2:
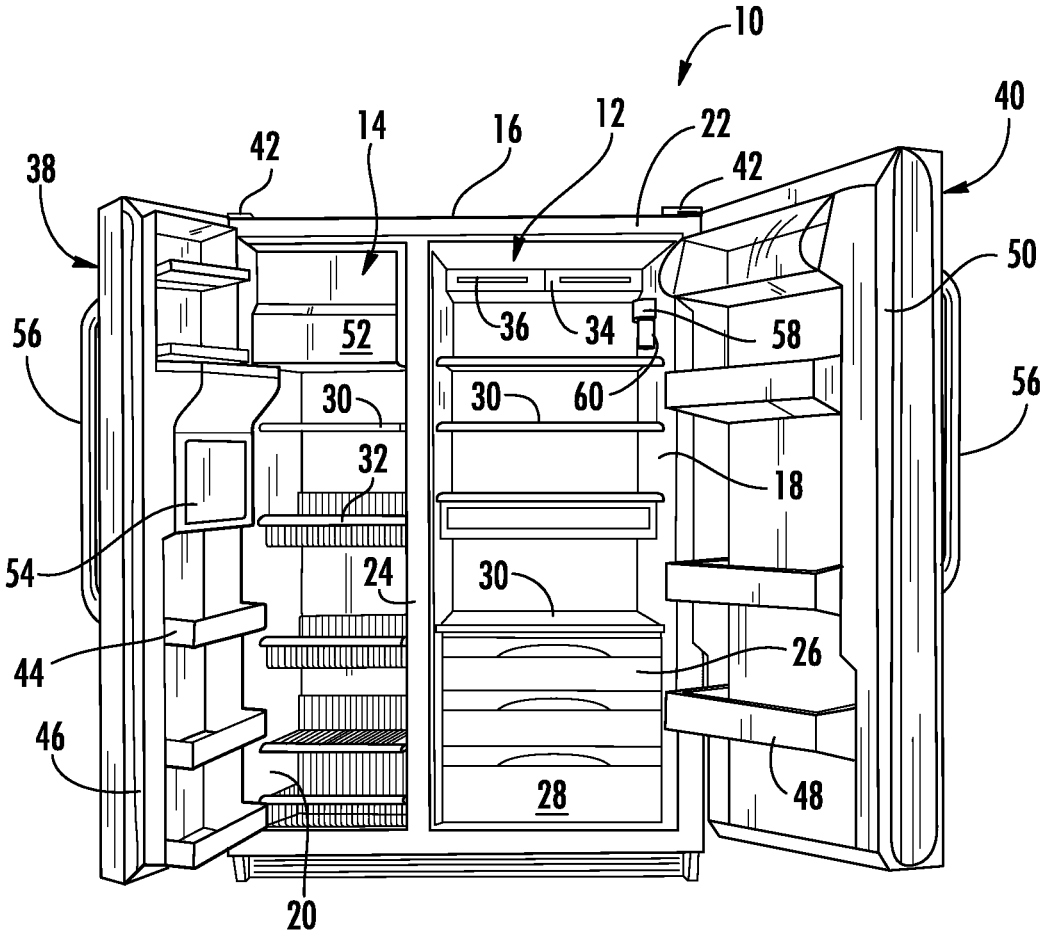
FIG. 2 provides a front view of the refrigeration appliance of FIG. 1 with its doors opened.

Referring to FIG. 2, the refrigeration appliance 10 includes a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 is conventional. A housing 58 may hold a water filter 60 used to filter water for the ice maker 52 and/or dispenser 54.

As with known refrigerators, the refrigeration appliance 10 also includes a machinery compartment (not shown) that at least partially contains components for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to directly cool the ice maker to form ice cubes, and a heating loop can be added to help remove ice from the ice maker, as discussed below. Collectively, the vapor compression cycle components in a refrigeration circuit, associated fans, and associated compartments are conventionally referred to as a sealed system. The construction and operation of the sealed system are well known to those skilled in the art.

Figure 3:
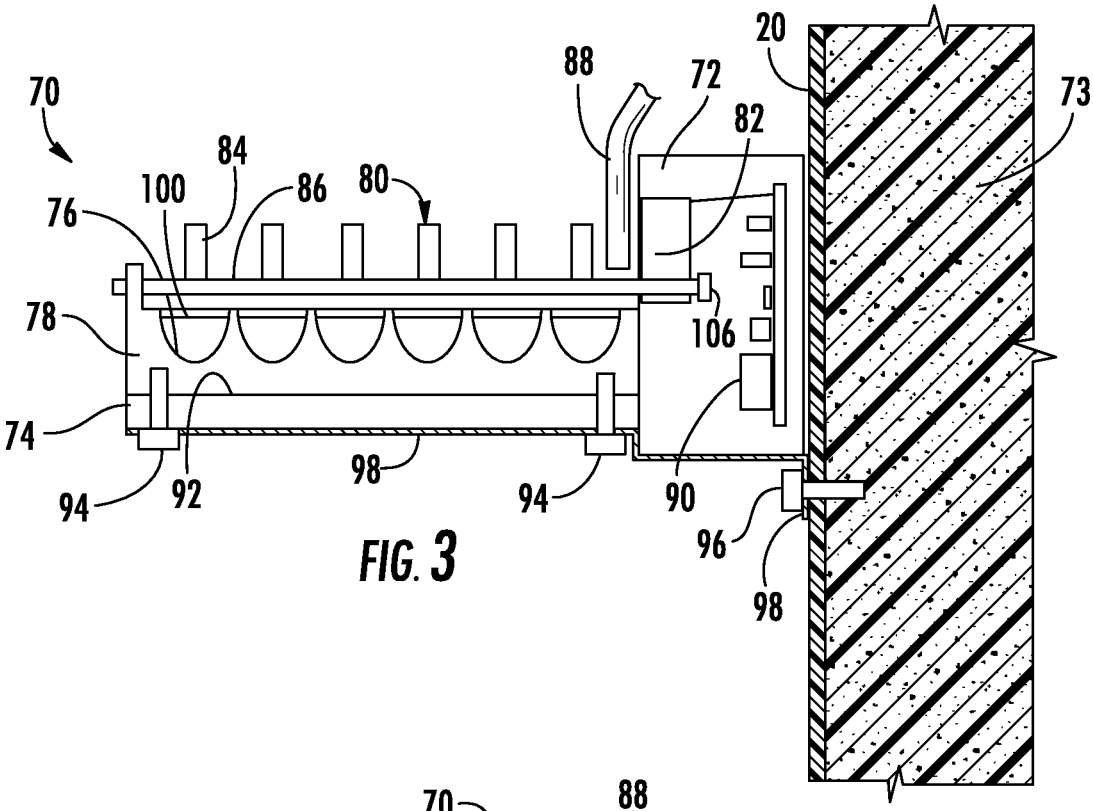
FIG. 3 provides a schematic side view of one ice making assembly in a refrigeration appliance according to certain aspects of the present disclosure.

As shown in FIG. 3, ice maker assembly 70 includes an ice maker 72 mounted on a plate 74. Plate 74 may be a directly cooled plate for chilling water in compartments 76 of mold body 78, or simply a bottom part of the mold body/ice maker assembly. Ice maker assembly 70 can be mounted as shown to inner liner wall 20 of freezer compartment 14 backed by insulation 73, although it could be mounted in other locations in any refrigerated compartment. Ice maker 72 makes a number of ice cubes 100 at a time automatically from a water source. Ice maker 72 may therefore make 6-8 cubes per cycle, and over 100 ice cubes per day, for example, in ice cube mold compartments 76 formed within mold body 78.

Figure 4:
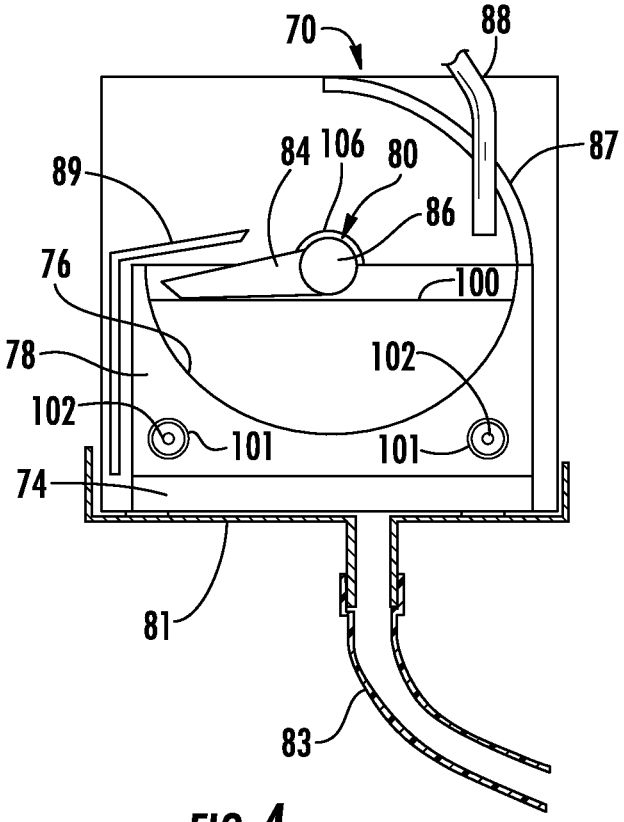
FIG. 4 provides a schematic end view of the ice making assembly of FIG. 3.

Ice cubes 100 are dumped periodically into an ice bucket assembly (not shown) in a conventional fashion, for example by virtue of a rotatable ice harvester 80. As shown, harvester 80 includes a motor 82 for driving a number of tines 84 mounted on a rod 86 through ice cube mold compartments 76 to remove the ice cubes once formed. Ice maker 72 also includes a water source 88 for filling compartments 76 once emptied. Deflector 87 and guide 89 help guide ice cubes 100 from compartments 76 down and to the left (as shown in FIG. 4) toward an ice bucket or the like (not shown). Ice maker 72 may be connected to a controller 90, which may be a dedicated controller or which may comprise controller 34 mentioned above. Alternatively, ice maker 72 may be a purely electromechanical device with no controller or logic function, as described below.

If plate 74 is a cooling plate, it may be made of a substance that readily transmits thermal energy. For example, cooling plate 74 may be a metal such as aluminum with a large area of contact 92 with mold body 78 so as to maximize heat transfer from the mold body to the cooling plate to make ice.

Plate 74 may be removably attached to ice maker 72 with fasteners 94 such as screws. Plate 74 may also be mounted to a surface such as inner liner wall 20 with additional fasteners 96 and a bracket 98, although the plate could be attached to the inside of the refrigerated compartment in various ways, either removably or permanently. As shown in FIG. 4 (not in FIG. 3, for clarity), a drain pan 81 and drain tube 83 may be employed in case of condensation or melting from ice maker 72, for example from ice cube harvesting or defrosting.

Plate 74 may have an optional heat exchange tube 101 within it (see FIG. 4) to provide heating or cooling to the plate and in turn mold body 78 to form ice or to help harvest ice cubes 100, respectively. Therefore, tube 101 can be a portion of the vapor compression refrigerant cycle, as described below, carrying refrigerant at a temperature lower than the mold body 78 to draw heat from the mold body to make ice. Tube 101 may also carry warmer refrigerant in some situations to provide a short heating of the mold body 78 to assist in removing ice cubes 100 once formed from individual mold compartments 76 if desired. Tube 101 can also carry an electrical resistance heating strip 102 within it, whether plate is directly cooled or not, for assisting in removal of ice cubes. Heating strip 102 can have various other orientations and locations within or adjacent plate 74, if desired. Alternatively (not shown), one tube for cold refrigerant and another for warm refrigerant could be provided through plate 74. It should therefore be understood that the present disclosure is not limited to any type of ice maker, whether environmentally cooled or directly cooled.

Figure 5:
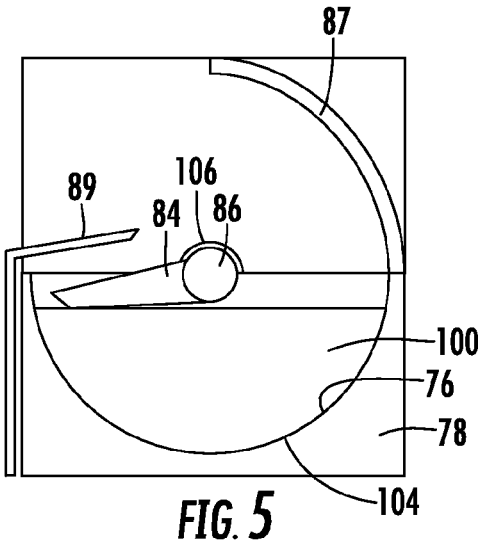
FIG. 5 provides a schematic end close up view of an ice making cavity showing a home position for harvester with a first type of sensor.

FIG. 5 shows a close up diagrammatical view of one ice cube compartment 76 within mold body 78 for making an ice cube 100. In FIG. 5, ice cube 100 is formed and is ready for harvest from compartment 76. Some sort of heating element (not shown in FIG. 5) is provided for heating each ice cube 100 to create a melted portion 104 to assist in removal of the ice cube from compartment 76. The heating element may include a heating strip 102 as above within mold body 78 or tube 101, tube 101 itself or an alternate tube for carrying heated refrigerant liquid, or any other heating element. If desired, a thermistor or the like (not shown) can be provided to measure temperature in mold body 78 to control heating. Accordingly, there should be no limitation regarding choice of heating element.

An ice harvesting assembly may include structure such as harvester 80, having includes motor 82 for driving elements 84 such as tines, plates, etc., mounted on a rod 86 through ice cube mold compartments 76 to remove ice cubes 100 once formed. Accordingly, when harvest is to be commenced, the heating element is activated to slightly melt ice cubes 100 to form melted portions 104. After a second period of time motor 82 is energized to rotate rod 86, thereby moving element 84 through compartments 76 and pushing ice cubes 100 out.

However, it should be understood that in some embodiments motor 82 is energized simultaneously with the heating element. Rod 86 would thus begin to rotate when ice cubes 100 are freed from compartments 76 by melting. Thus, the second period of time measured from heater start to motor start could be considered to be zero in such embodiment. Such a system could be employed if a less complicated device were desired for a particular application but could also be employed with a full controller based system as well.

Figure 6:
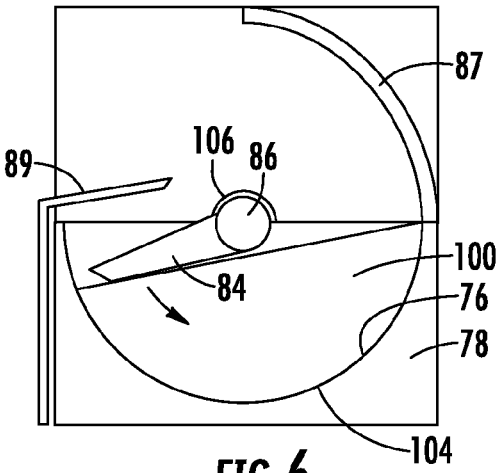
FIG. 6 provides a schematic end close up view of the assembly of FIG. 5 showing an ice cube freed position.
Figure 7:
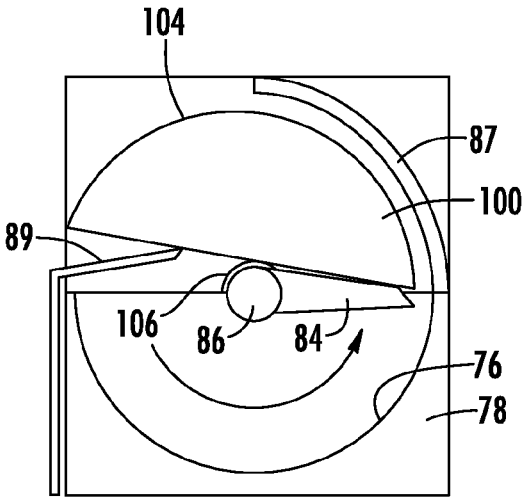
FIG. 7 provides a schematic end close up view of the assembly of FIG. 5 showing a stop/refreezing position.

As shown in FIG. 6, rod 86 has been rotated counter-clockwise enough to begin moving ice cube 100 out to compartment 76. As shown in FIG. 7, rod 86 has been rotated further counter-clockwise. Harvester 80 has stopped for a time at a stop position in which melted portion 104 is not in contact with compartment 76 any longer. As shown in FIG. 7, ice cube 100 is sitting atop harvester 80 and mold body 78 with melted portion 104 upward. Melted portion 104 can thus refreeze before harvester completes a rotation back to the position of FIG. 5. Additional water for the next ice cube can be added to compartment 76 via inlet 88 either at the position shown in FIG. 7 or after completion of the cycle back at the FIG. 5 position, as desired.

Control of harvester 80 can be accomplished in various ways. For example, as shown in FIGS. 3-7, a sensor 106 can be attached to rod 86 to determine rotational position. Sensor 106 can be a conventional potentiometer or other rotational sensor attached to rod 86 and electrically connected to controller 90 and/or 34. Motor 82 can thus be driven using feedback from sensor 106 to determine and control the position of harvester 80 as desired to remove ice cubes 100 from compartments 76, allow some dwell time for refreezing, and then dump them off into an ice bucket or the like.

If desired, feedback from sensor 106 can be used to identify when harvester 80 has reached the position shown in FIG. 6. Such position occurs just after ice cube 100 has been removed from compartment 76. If the heating element has been activated along with or soon followed by activation of harvester 80, ice cube portion 104 may not be formed yet. In other words, motor 82 of harvester 80 could be turned on before the heating element has sufficiently melted ice cubes 100 to free them from compartments 76. Once sufficient melting occurs, ice cubes 100 will be free and rod 86 will turn. When rod reaches the rotational position shown in FIG. 6, the heating element can be turned off by the controller. Therefore, only the amount of energy needed to sufficiently melt the ice cubes is employed. This minimizes energy used for heating and minimizes melting of ice cubes. Accordingly, the amount of time needed for refreezing would also be minimized. Thus, obtaining feedback as to position of the harvester just after the ice cubes are freed can beneficially help save energy in more than one way.

Figure 8:
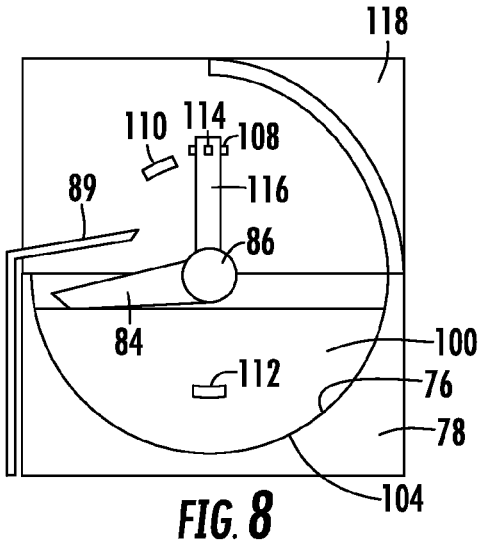
FIG. 8 provides a schematic end close up view of an ice making cavity showing a home position for harvester with a second type of sensor.
Figure 9:
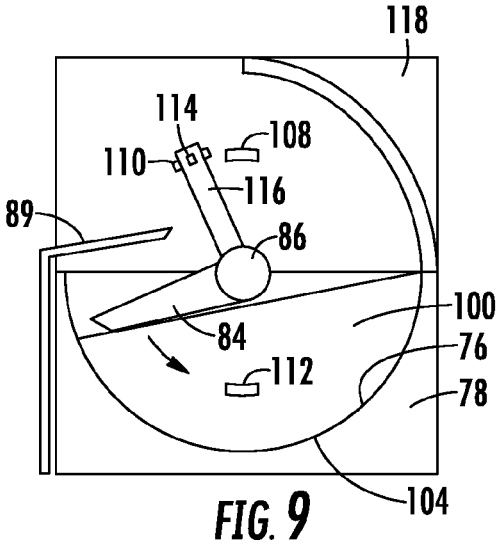
FIG. 9 provides a schematic end close up view of the assembly of FIG. 8 showing an ice cube freed position.
Figure 10:
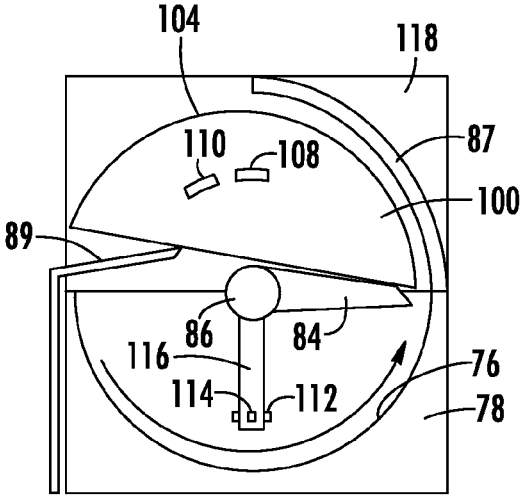
FIG. 10 provides a schematic end close up view of the assembly of FIG. 8 showing a stop/refreezing position.

As shown in FIG. 8-10, an alternate sensor arrangement can be employed. Instead of a sensor 106 such as on rod 86, the sensor mechanism employs multiple sensor elements which can be detectors 108,110,112 that can be employed to detect a target 114 on harvester 80. As shown, target 114 can be a magnet located on an arm or other element 116 extending outward from rod 86 at one end of the rod adjacent a plate 118 on which sensor elements 108,110,112 are mounted.

Alternatively, detectors 108, 110, 112 can be mechanical switches and target 114 can be an extending element, cam, etc. for making physical contact. In such embodiment, detectors 108, 110, 112 could be connected directly to motor 82 without use of a controller, if a simplified construction were desired. Therefore, sensor element 108 can be located to detect target 114 when at the home position (FIG. 8), sensor element 110 (optional) can be located to detect the target at the ice cube freed position (FIG. 9), and sensor element 112 can be located to detect the target at the stop/refreezing position (FIG. 10). The function of the alternate sensor arrangement is the same as described above with respect to interaction with the motor, controller (optionally), and other elements. If target 114 is a magnet, sensor elements 108,110, 112 may be conventional Hall Effect transducers. However, various other electromechanical, sonic or optical position sensing devices could be used such as switches, buttons, lasers, etc.

It would be possible to reverse positions within the sensor mechanism so that element 114 is a detector such as a Hall Effect transducer, mechanical switch, etc., and sensor elements 108,110,112 are targets, cam elements, etc. In such case, electrical connection between element 114 and the motor and/or controller would have to be by a movable (rotatable wiper, slip ring, mercury, etc.) or wireless connection. Also, a timer and/or thermister could be used to determine when to move harvesting element and/or turn on or off the heating element after the periods of time noted herein. Or a combination of such inputs could be employed to detect rate of change (slope) of temperature in the mold body, indicating time for melting, time for removal of the ice cube from the compartment. Therefore, passage of periods of time need not be measured directly. Therefore, no limitation should be implied as to the type of single or multiple sensor elements used to determine position of the harvesting device, and as to whether the "sensing" is done from the rotatable harvesting assembly or from the fixed housing. The claimed multiple sensor elements could therefore be multiple detectors or targets as desired. And other sensing could be done and used to control the harvesting device and heater to measure or as a proxy for the measurement of time periods.

Accordingly, various options and modifications to the above structures can be employed, and combinations of features of the above refreezing structures and functions, heating source, mold bodies, harvest structures, etc. can be envisioned in view of the present disclosure. An ice maker with an ice cube harvesting device can be practiced in many ways. The ice maker may therefore be useful in more readily removing ice for harvest, preventing refreezing of ice cubes together, and/or preventing ice cubes from freezing to the ice maker itself or other cold surfaces. Ice can be made more continuously and dispensed more uniformly. Reduced energy usage can be achieved by using only the amount of heat energy required to free the ice cubes and then turning off the heating element. Energy use may be reduced as well by eliminating or limiting the amount of effort needed by movable devices within the ice bucket and/or dispenser to break apart refrozen clumped ice cubes for dispensing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly for a refrigeration appliance comprising:

an ice maker including a mold body defining a plurality of compartments for forming ice cubes therein;

a heating element positioned adjacent the mold body and configured for heating the ice cubes within the compartments of the mold body in order to create a melted portion on each ice cube of the ice cubes; and a harvesting assembly including a plurality of elements attached to a rotatable rod, each element being movable via rotation of the rod through a respective one of the compartments of the mold body in order to remove the ice cubes from the compartments, the harvesting assembly rotatable between a harvesting position and a stop position, the elements of the plurality of elements contacting the ice cubes within the compartments of the mold body when the harvesting assembly is in the harvesting position, the ice cubes positioned atop the harvesting assembly when the harvesting assembly is in the stop position, the harvesting assembly configured for maintaining the rod in the stop position for a period of time in order to refreeze the melted portion of the ice cubes.

2. The ice making assembly of claim 1, further including a sensor for determining a rotational position of the harvesting assembly.

3. The ice making assembly of claim 2, wherein responsive to the sensor sensing that the harvesting assembly is in the stop position, the harvest assembly stops for the period of time.

4. The ice making assembly of claim 3, wherein after the period of time expires the harvesting assembly is configured to rotate toward a home position, thereby delivering the ice cubes to a receptacle.

5. The ice making assembly of claim 2, wherein responsive to the sensor sensing that the ice cubes are free from the compartment the heating element is deactivated.

6. The ice making assembly of claim 2, wherein responsive to the sensor sensing that the harvesting assembly is in a home position, the harvest assembly stops for a first period of time sufficient to form ice cubes in the compartments.

7. The ice making assembly of claim 6, wherein after the first period of time expires the heating element is reactivated.

8. The ice making assembly of claim 7, wherein after a second period of time expires after activating the heating element, the harvesting assembly is configured to rotate towards the harvesting position.

9. The ice making assembly of claim 2, wherein the sensor includes a first sensor element for indicating that the harvest assembly is in the stop position.

10. The ice making assembly of claim 9, wherein the sensor includes a second sensor element for indicating that the ice cubes are free from the compartments.

11. The ice making assembly of claim 10, wherein the sensor includes a third sensor element for indicating that the harvest assembly is in a home position.

12. A refrigeration appliance comprising:

a refrigerated cabinet;

an ice maker within the refrigerated cabinet including a mold body defining a plurality of compartments for forming ice cubes therein;

a heating element positioned adjacent the mold body and configured for heating the ice cubes within the compartments of the mold body in order to create a melted portion on each ice cube of the ice cubes; and a harvesting assembly including a plurality of elements attached to a rotatable rod, each element being movable via rotation of the rod through a respective one of the compartments of the mold body in order to remove the ice cubes from the compartments, the harvesting assembly rotatable between a harvesting position and a stop position, the elements of the plurality of element contacting the ice cubes within the compartments of the mold body when harvestin assembly is in the harvesting position the ice cubes positioned atop the harvesting assembly when the harvesting assembly is in the stop position,the harvesting assembly configured for maintaining the rod in the stop position for a period of time in order to refreeze the melted portion of the ice cubes.

13. The refrigeration appliance of claim 12, further including a sensor for determining a rotational position of the harvesting assembly.

14. The refrigeration appliance of claim 13, wherein responsive to the sensor sensing that the harvesting assembly is in the stop position the harvest assembly stops for the period of time.

15. The refrigeration appliance of claim 14, wherein after the period of time expires the harvesting assembly rotates toward a home position, thereby delivering the ice cubes to a receptacle.

16. The refrigeration appliance of claim 13, wherein responsive to the sensor sensing that the ice cubes are free from the compartment the heating element is deactivated.

17. The refrigeration appliance of claim 13, wherein responsive to the sensor sensing that the harvesting assembly is in a home position, the harvest assembly is configured to stop for a first period of time sufficient to form ice cubes in the compartments, and after the first period of time expires the heating element is activated for a second period of time.

18. The refrigeration appliance of claim 17, wherein after the second period of time expires the harvesting assembly is configured to rotate towards the harvesting position.

19. A method for forming ice cubes, comprising:

directing liquid water into a plurality of compartments of a mold body;

freezing the liquid water within the plurality of compartments of the mold body in order to form ice cubes within the plurality of compartments of the mold body;

heating the ice cubes within the plurality of compartments of the mold body such that a melted portion is formed on each ice cube of the ice cubes;

rotating a harvesting assembly such that elements of the harvesting assembly remove the ice cubes from the plurality of compartments of the mold body; and holding the ice cubes atop the harvesting assembly for a period of time such that he melted portion on each ice cube of the ice cubes refreezes.

* * * * *